US006577217B1

(12) United States Patent
Bournarie et al.

(10) Patent No.: US 6,577,217 B1
(45) Date of Patent: Jun. 10, 2003

(54) OPTIMIZED MAGNETIC SUB-ASSEMBLY

(75) Inventors: Christophe Bournarie, Valff (FR); Davy Morian, Maisonsgoutte (FR); Thierry Lienhardt, Illkirch (FR)

(73) Assignee: Hager Electro, Obernai (FR)

( * ) Notice: Subject to any disclaimer, the term of this patent is extended or adjusted under 35 U.S.C. 154(b) by 0 days.

(21) Appl. No.: 09/701,925

(22) PCT Filed: Jun. 10, 1998

(86) PCT No.: PCT/FR98/01197

§ 371 (c)(1),
(2), (4) Date: Dec. 4, 2000

(87) PCT Pub. No.: WO99/63564

PCT Pub. Date: Dec. 9, 1999

(30) Foreign Application Priority Data

Jun. 3, 1998 (FR) ..... 98/07134

(51) Int. Cl.[7] ..... H01F 5/00
(52) U.S. Cl. ..... 335/282; 335/174

(58) Field of Search ..... 335/282, 167–176

(56) References Cited

U.S. PATENT DOCUMENTS 5,894,257 A * 4/1999 Roger et al. ..... 335/172

FOREIGN PATENT DOCUMENTS

EP 0569652 A1 * 11/1993
JP 2299120 * 11/1990

* cited by examiner

*Primary Examiner*—Lincoln Donovan
*Assistant Examiner*—Tuyen T. Nguyen
(74) *Attorney, Agent, or Firm*—Abelman, Frayne & Schwab

(57) ABSTRACT

A magnetic sub-assembly for modular electrical equipment of the circuit-breaker type includes a yoke having a leg at least partially integrated inside the inner volume of an induction coil so that a range of axial dimensions of the coil is allowed by the yoke, and one end of the coil is oriented so that its attachment to a fixed contact also allows the range of axial dimensions.

14 Claims, 5 Drawing Sheets

OPTIMIZED MAGNETIC SUB-ASSEMBLY

RELATED APPLICATIONS

This application is a 371 of PCT/FR98/01197 filed Jun. 10, 1998.

The present invention concerns a magnetic sub-assembly for modular electrical equipment of the circuit breaker type, as well as a circuit breaker incorporating such a sub-assembly.

Line protection circuit breakers generally comprise, in a modular casing with plastic shells, a circuit extending between two terminals and comprising a thermal triggering bimetallic strip for protecting the line against overloads and, between a terminal and a fixed contact, an electromagnetic circuit breaking device or magnetic tripping device often grouped together with these two components to form a magnetic sub-assembly.

The magnetic tripping device essentially comprises a coil with a moving core, associated with a striker so as to ensure a break in the case of excess current by opening a moving contact cooperating with a fixed contact.

In most cases, the circuit breaker more precisely comprises an induction coil mounted longitudinally in a magnetic yoke and surrounding the said moving core associated with the striker and with a fixed core, a return spring disposed between the cores completing the assembly. This spring makes it possible in particular to return the moving core into the rest position, with the striker in an inactive position, namely away from the magnetic lock enabling the contacts to open by the tilting of the moving contact.

The yoke consists of a metal sheet made of magnetic material generally surrounding the coil in order to channel the field lines produced correctly, when a current passes through the coil. The yoke has legs facing each other either side of the said coil in an axial direction, one of which is provided with a fixed core, and in the region of which the other elements of the magnetic sub-assembly are generally disposed, i.e. one of the connecting terminals of the circuit breaker and the fixed contact respectively.

The magnetic sub-assemblies mounted in this way in a single piece are then positioned in a part of the plastic shell of the casing when the circuit breaker is assembled. As may be supposed by their function, these magnetic sub-assemblies are essential elements of circuit breakers and their design is consequently the subject of special attention as well as many tests designed to prove the validity of the recommended solutions. Since the main function is associated with the existence of sudden excess currents, certain of these tests are naturally carried out in different short-circuit configurations or at least with equal currents and several times the value of the nominal current for which the performances of the magnetic sub-assembly are measured.

During these periods of extreme operation, one of the parameters which is checked in a particularly rigorous manner is the force needed to pull the contacts apart. The aim of these checks and the resulting adjustments is to refine the triggering conditions of the mechanical lock by means of a better control of the electromagnetic triggering device and the force conveyed by the striker.

Heating of different parts of the magnetic sub-assembly is also a sensitive parameter for which tests are carried out with a nominal current or slightly above this, with the aim of reducing it as much as possible.

The main objects of the present invention which are also concerned are those which aim overall at optimizing the design of magnetic sub-assemblies fitted to circuit breakers, in particular but not exclusively for the aforementioned ends.

According to an additional objective, this optimization must be achieved without changing the installation conditions of the said magnetic sub-assembly in the shells forming the casing of the circuit breaker. In other words, the overall size which it is allotted in the casing remains the same.

Optimization, which is the object of the invention, and which in particular makes it possible for circuit breakers to satisfy the standards in force in the United States of America, is also exercised in all possible directions and concerns both the choice of materials as well as the form of the components or manufacturing considerations.

The present invention therefore applies to a magnetic sub-assembly of modular electrical equipment of the circuit breaker type, composed on the one hand of an induction coil associated with a moving core with striker and return spring disposed in an insulating sheath, the said coil being mounted longitudinally in a yoke having two legs facing each other, the first leg being provided with a fixed core in which the striker is guided and on the other hand of a fixed contact to which a first end of the coil is connected and a terminal for connection to the circuit breaker to which the second end of the coil is connected, characterized in that the leg of the yoke disposed beside the end of the coil provided so as to be connected to the fixed contact has dimensions so that it can be at least partially integrated inside the interior volume of the coil so as to absorb any possible axial dimensional variations thereof, of which the corresponding end is oriented so that its attachment to the fixed contact, of which the position is fixed relative to the yoke, enables the axial play of the coil to be taken up.

It is in point of fact found that, on manufacture, coils may have an axial dimensional scatter which may reach more than 1 mm whereas the yoke can be manufactured in a much more precise manner, on account of its very nature, namely a metal sheet simply bent according to a particular geometry.

The coil has also been the object of modifications within the framework of the present invention, as will be seen in greater detail hereinafter, but its minimum number of turns is prescribed to preserve the necessary ampere-turns for the force of pulling the contacts apart. Since the cross section of the wire is in particular large in circuit breakers sizes to which the present invention applies (50–63 A), and since this cannot be modified, a dimensional scatter during manufacture is virtually inevitable.

For reasons of optimizing manufacture, only one geometrical configuration of the yoke is produced, provided of course with the improvement of the invention. This yoke has two end legs in the region of which a connecting terminal and the fixed contact are attached respectively, the fixed contact being in the form of a metal strip on which a point is added at the precise location of contact with the moving contact.

This fixed contact has, according to the invention, an extension for attaching it axially to the leg of the yoke, consequently provided with an orifice for housing the end of the fixed core, and of which the periphery is finally also dimensioned so that it can be partially integrated inside the inner volume of the coil, close to the end thereof.

The fixed polar core is thus incorporated on the one hand with one leg of the yoke, and on the other hand with the fixed contact of which the extension in question is coaxial with the said leg. This extension has moreover the same characteristics as this leg and facilitates the assembly of all the coils resulting from mass production.

In addition, the end of the coil to be connected to the fixed contact is oriented in a direction substantially parallel to the axis of the coil, and is attached to a lug of the fixed contact situated in the immediate vicinity of the contact point fitted to the said fixed contact, the said lug having to this end a surface running parallel to the said end.

The orientation of the said end makes it possible to make the connection in the same manner whatever the overall size of the coil, which represents a considerable novel advantage as regards manufacture.

The fact that this connection is made immediately next to the fixed contact minimizes heating.

Still with the point of view of reducing heating, the cross section of the electrical wire forming the induction coil has a rectangular appearance, with a radial thickness less than the axial width so as to increase on the one hand the inner volume enclosed by the said coil and so as to reduce on the other hand the length of wire necessary for the same coil length.

As will be seen hereinafter, this measure also has a direct influence over the control needed to pull the contacts apart.

According to a configuration improving still further the heat reduction effect, while still preserving the rectangular appearance of the cross section, the axial width of the wire can be increased still further if the thickness of the metal sheet forming the yoke is reduced, the external volume of which remains however unchanged.

The magnetic sub-assembly provided with these improvements can however still be installed in the same shells or portions of shells as its predecessors.

The direct consequence of increasing the volume enclosed by the coil is that, as a corollary, it is possible to increase the length of the diameter of the fixed and moving cores, which are the polar components generating the force for separating the contacts.

In addition, according to the invention, the yoke is U-shaped, the arm joining the two end legs being on the same side of the coil as the fixed contact and the connecting terminal.

This shape makes it possible to end up with a volume of magnetic material constituting a good compromise between those which would lead to better performances for very high short circuit currents and those which are more suited to lower short circuit currents.

As mentioned previously, tests were carried out for different possible short circuit currents, extending from very high values producing complete saturation of the yoke whatever its shape and material, to lower values for which these parameters have a very great importance.

The U-shape correctly channels magnetic field lines at lower test values (180 A, 300 A) which makes it possible in particular to use a spring with a lower stiffness. It is on the other hand very efficient at saturation and guarantees the aforementioned non-tripping limits for medium currents.

According to one possibility, the end of the arm joining the legs of the yoke situated on the side of the connecting terminal has a side notch provided for attaching the second end of the coil to the said terminal without it contacting the yoke. The said end is oriented in a plane perpendicular to the axis so as to leave the winding forming the said coil tangentially.

The two ends of the coil are therefore substantially perpendicular to each other and are designed so as to facilitate their attachment to the connecting terminal and the fixed contact respectively, combined with the special shape of the yoke and these elements.

Preferably, the end of the coil on the terminal side is attached to a lug extending the upper part of the connecting terminal having a surface running perpendicular to the axis of the coil, attachment being made in the region of the said notch. This configuration makes it possible to take up play perpendicular to the longitudinal middle plane of the casing of the circuit breaker if this is necessary.

According to a variant, the end of the coil is oriented axially so as to leave the yoke in the region of the said notch, attachment to the connecting terminal being made outside the volume surrounded by the yoke.

The yoke is moreover provided in a material which depends in particular on the choice of spring. Accordingly, it is made of copper or steel, the return spring of the core being for example provided with a lower force in the first case. This characteristic underlines at what point adjustments made to certain parameters are closely linked to the possibilities offered by other parameters, the aim being always to arrive at the best possible compromise, which calls for many varied tests.

According to the invention, the core is preferably made of steel, a material which is more magnetic than brass generally used hitherto for high nominal intensities, and which contributes to improved control over the force for separating the contacts.

The invention also concerns a circuit breaker characterized in that it includes a magnetic sub-assembly such as described previously.

The invention will now be described in greater detail with reference to the accompanying figures, for which:

Figure 1:
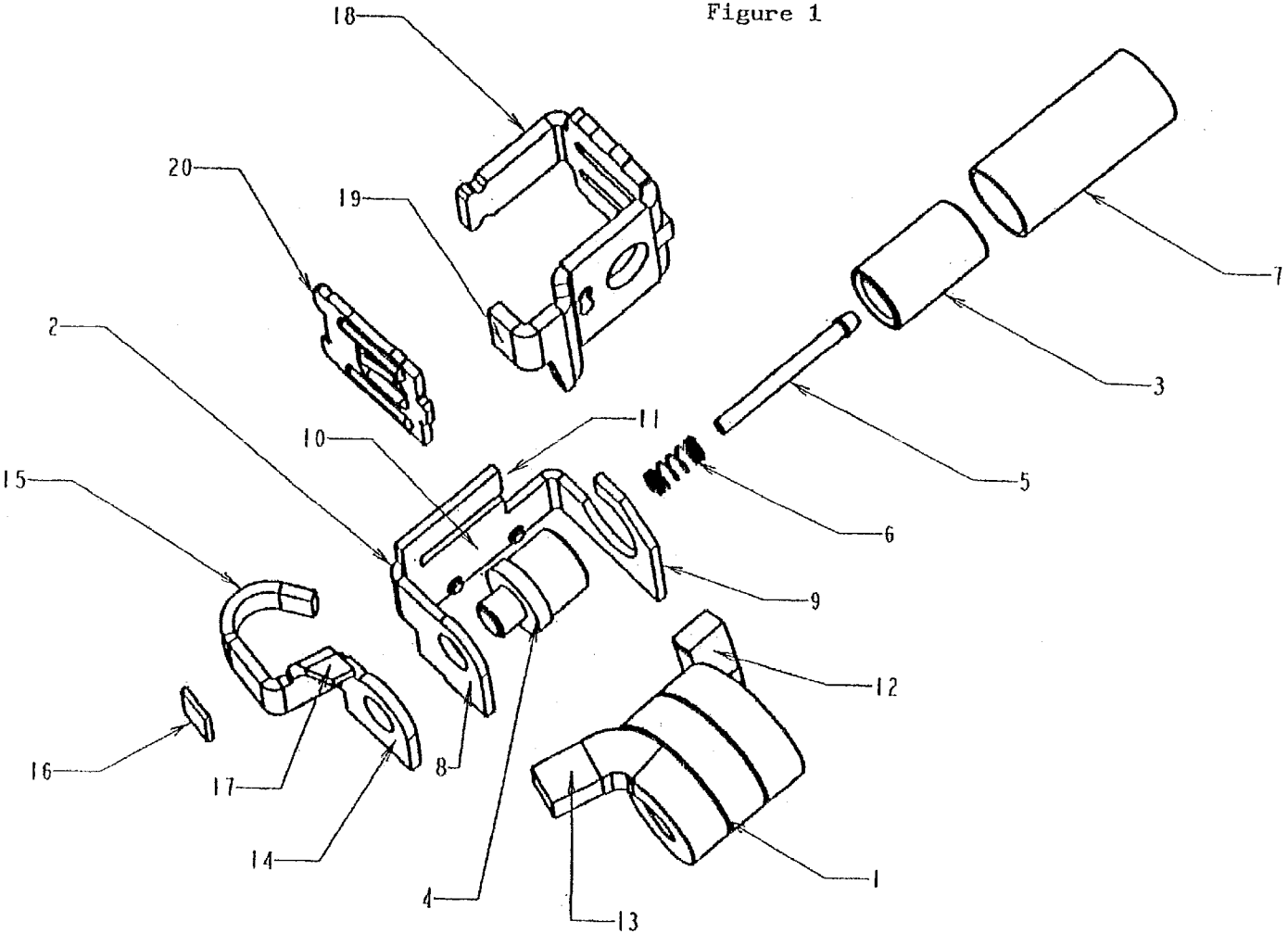
FIG. 1 is an exploded perspective view of the different components of the magnetic sub-assembly according to the invention.

In the different figures, the components are denoted by the same references. Thus in FIG. 1, the central elements of the magnetic sub-assembly are the coil (1) and the magnetic yoke (2), inside which are situated the moving core (3), the fixed core (4), the striker (5) and the return spring (6), these latter elements being positioned inside an insulating sheath (7).

The yoke (2) itself has end legs (8, 9), joined by an axial arm (10) provided with a notch (11) in the vicinity of the leg (9), in the region of which the straight end (12) of the coil (1) is situated. The said end runs tangentially to the said coil (1) and substantially perpendicular to the other straight end (13) which proceeds more in an axial direction.

The leg (8) is provided with a form such that it is possible to insert it inside the volume of the coil (1), as will be shown in greater detail hereinafter. An extension (14) of the fixed contact (15) with a form partially similar to that of the said leg (8), is placed on its outer face, and on which extension a point (16) is added at the precise position of contact with the moving contact (not shown).

The fixed contact (15) also includes a lug 17 offering an outer surface running parallel to the longitudinal axis of the magnetic sub-assembly, on which the straight end (13) of the coil (1) is attached.

The other leg (9) is situated close to the connecting terminal (18), which is extended by a lug (19) having a surface running perpendicular to the said longitudinal axis, on which the other straight end (12) of the coil (1) is attached in the region of the step or notch (11). This terminal (18) has a removable wall (20).

Figure 2:
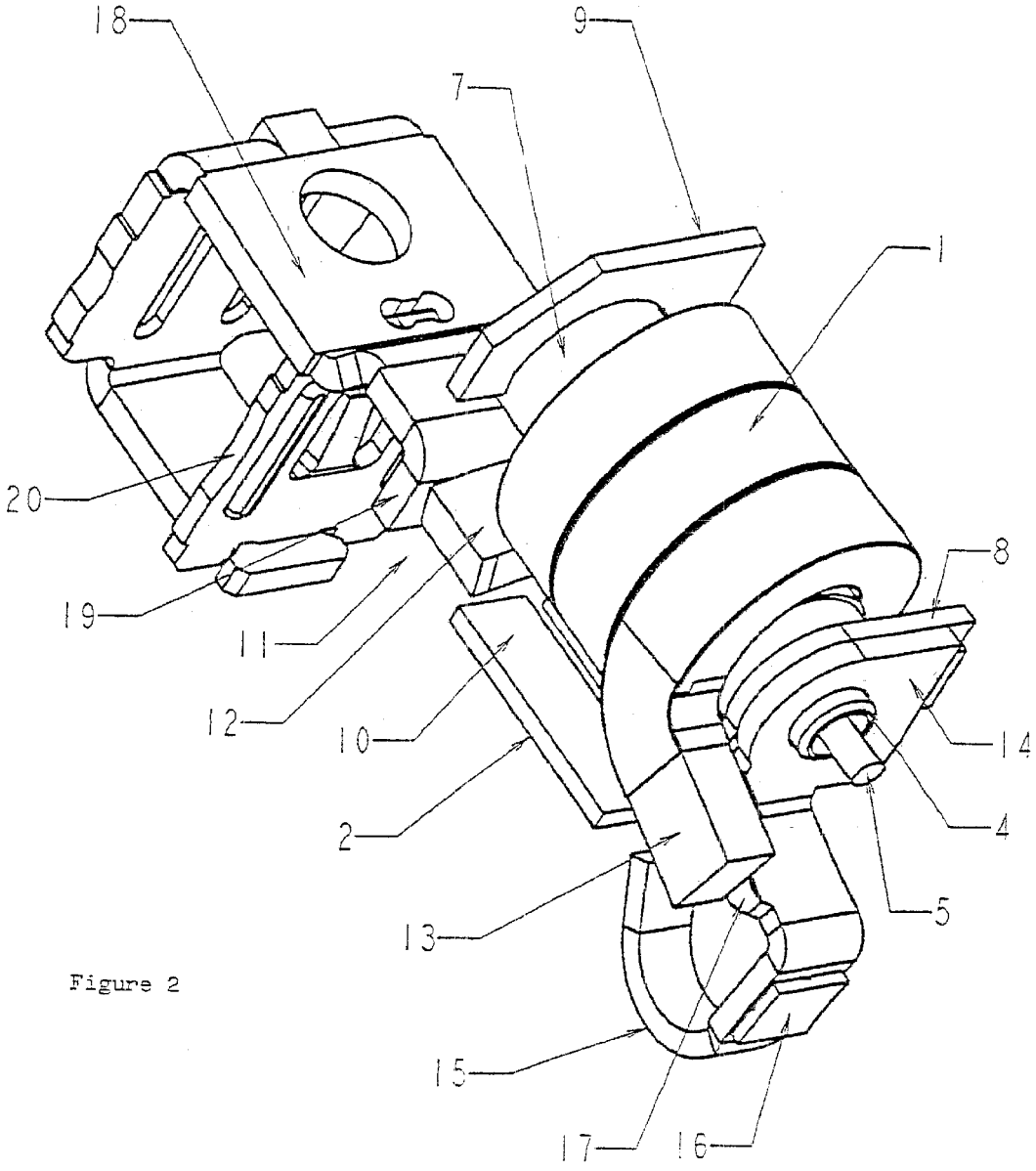
FIGS. 2 and 3 show perspectives of the assembled sub-assembly viewed from different angles.
Figure 3:
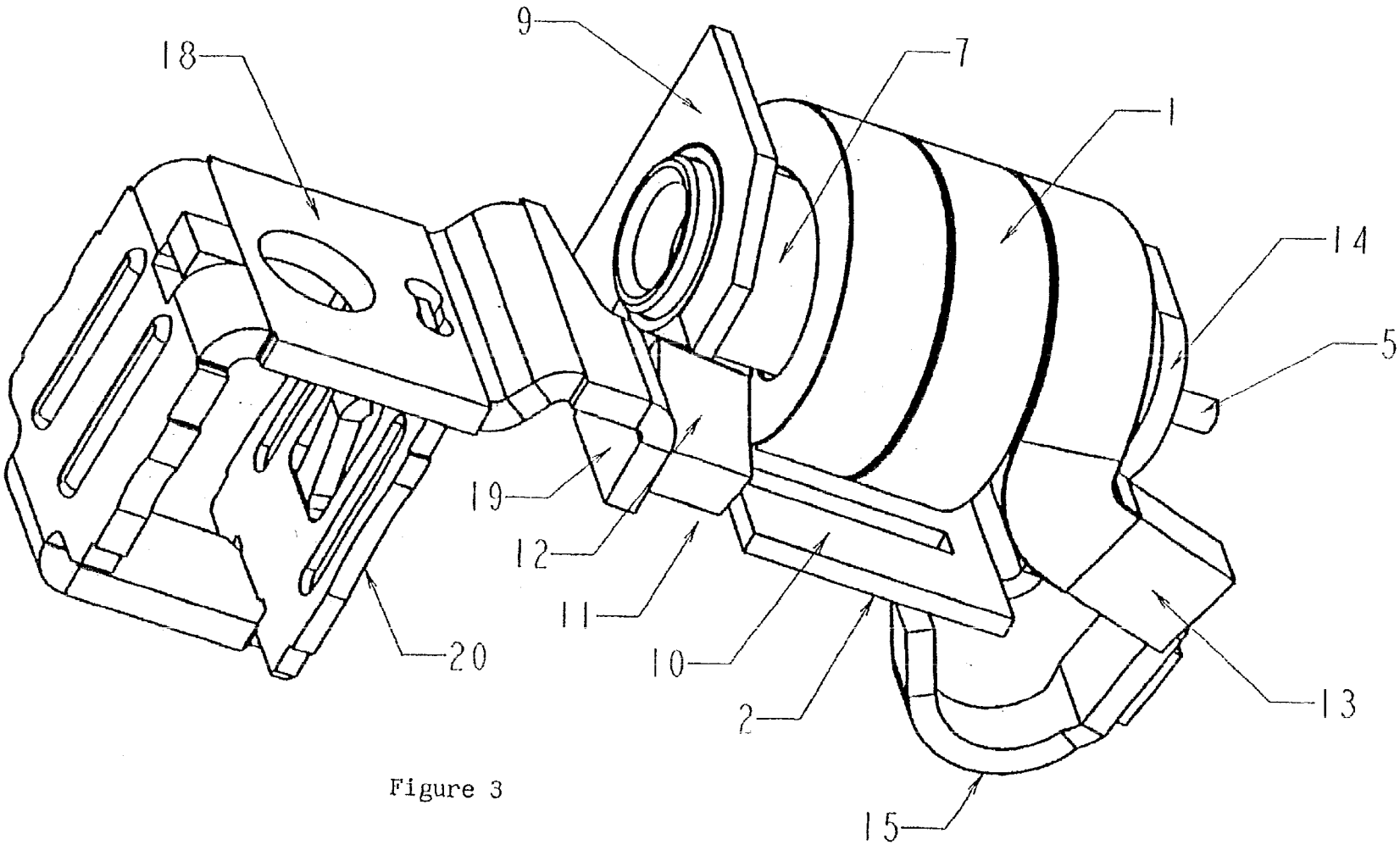

All these components are assembled to give the sub-assembly appearing in FIGS. 2 and 3. FIG. 2 is more precise as regards the connection between the coil (1) and the fixed contact (15), whereas FIG. 3 is clearer for the description of the connection between the coil (1) and the connecting terminal (18).

With reference to FIG. 2, the similarity in form between the extension (14) and the leg (8) is obvious in the end zone of the coil (1) close to the straight end (13). The latter is in contact with the lug (17) via a flat connecting surface which of course permits a certain latitude in the relative position at the moment of attachment (see also in FIG. 5).

This attachment zone is very close to the actual electrical contact, which is produced in the region of the point (16), in particular on account of the offsetting of the fixed contact (15) with respect to the longitudinal axis of the magnetic sub-assembly, in this case materialized by the striker (5) guided by the fixed coil (4).

At the other end of the coil (1) a contact configuration between the straight end (12) and the lug (19) is established in a plane substantially perpendicular to the preceding one. The attachment takes place in the notch (11) made in the arm (10) joining the legs (8,9) of the yoke (2).

The coil (1) has approximately three turns with a substantially rectangular cross section, which makes it possible to gain inner volume, to reduce the length of the wire necessary for its production, and consequently to reduce heating while increasing the polar areas of the core and thus the force for separating the contacts.

The metal sheet of the yoke (2) and particularly the arm (10), has undergone a reduction in thickness in order to permit the external volume to be increased, and consequently the internal cylindrical orifice of the coil (1).

Figure 4:
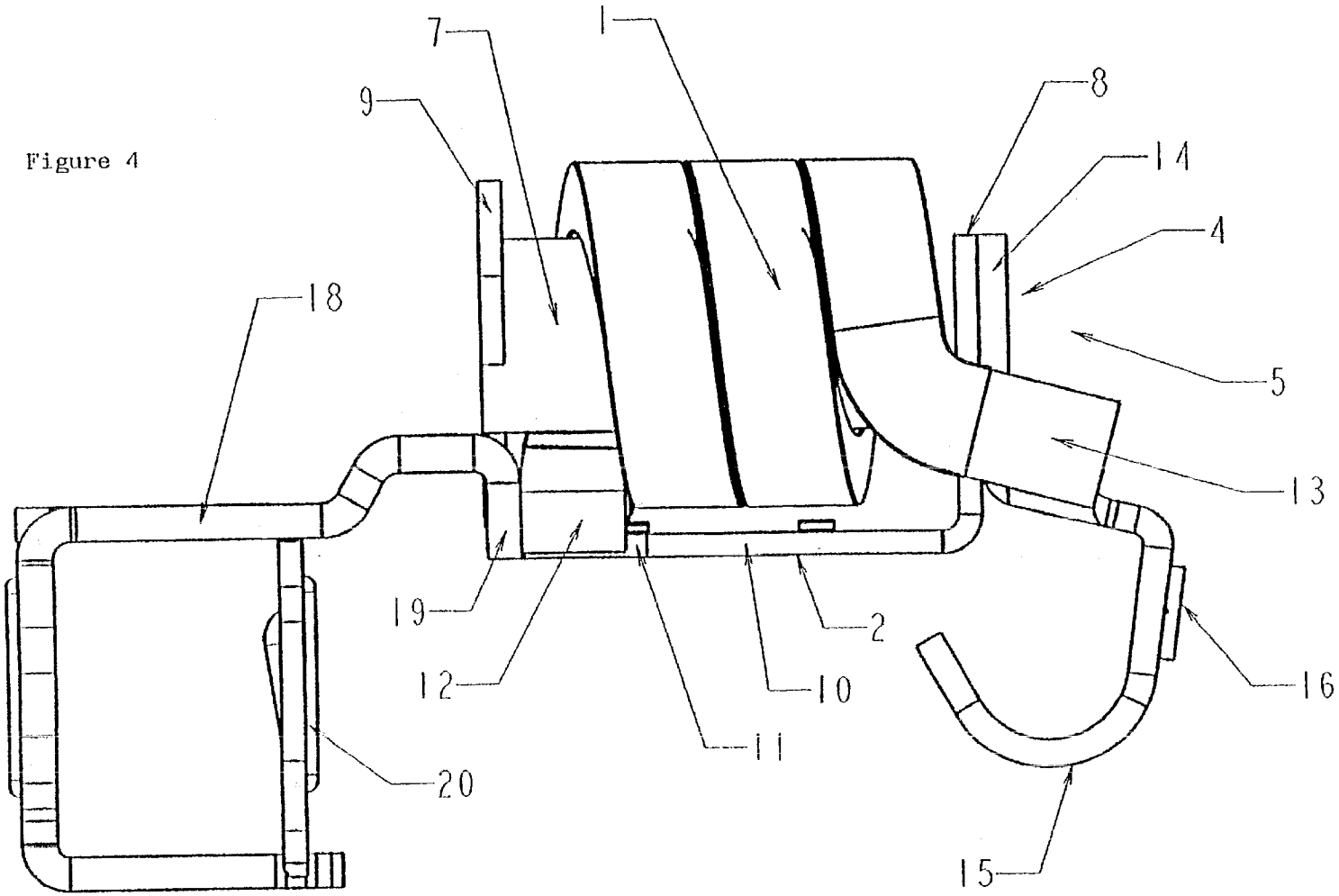
FIG. 4 is a view in elevation of the face of the said sub-assembly.

The angle of view provided by FIG. 3, as well as the view in elevation of FIG. 4 shows very clearly on the one hand the mechanical connections of the coil (1) and the elements outside the yoke (2), and on the other hand the geometrical configuration chosen for the coil (1). The connecting terminal (18) has itself undergone an increase in thickness over the part where the current passes, i.e. in the upper part, in order to reduce heating in this portion of the magnetic sub-assembly.

Since FIG. 4 is not in perspective, the proportions are rendered in a more exact manner, and this makes it possible to take account of the respective thickness of the metal sheets of the terminal (18) and of the yoke (2).

Figure 5:
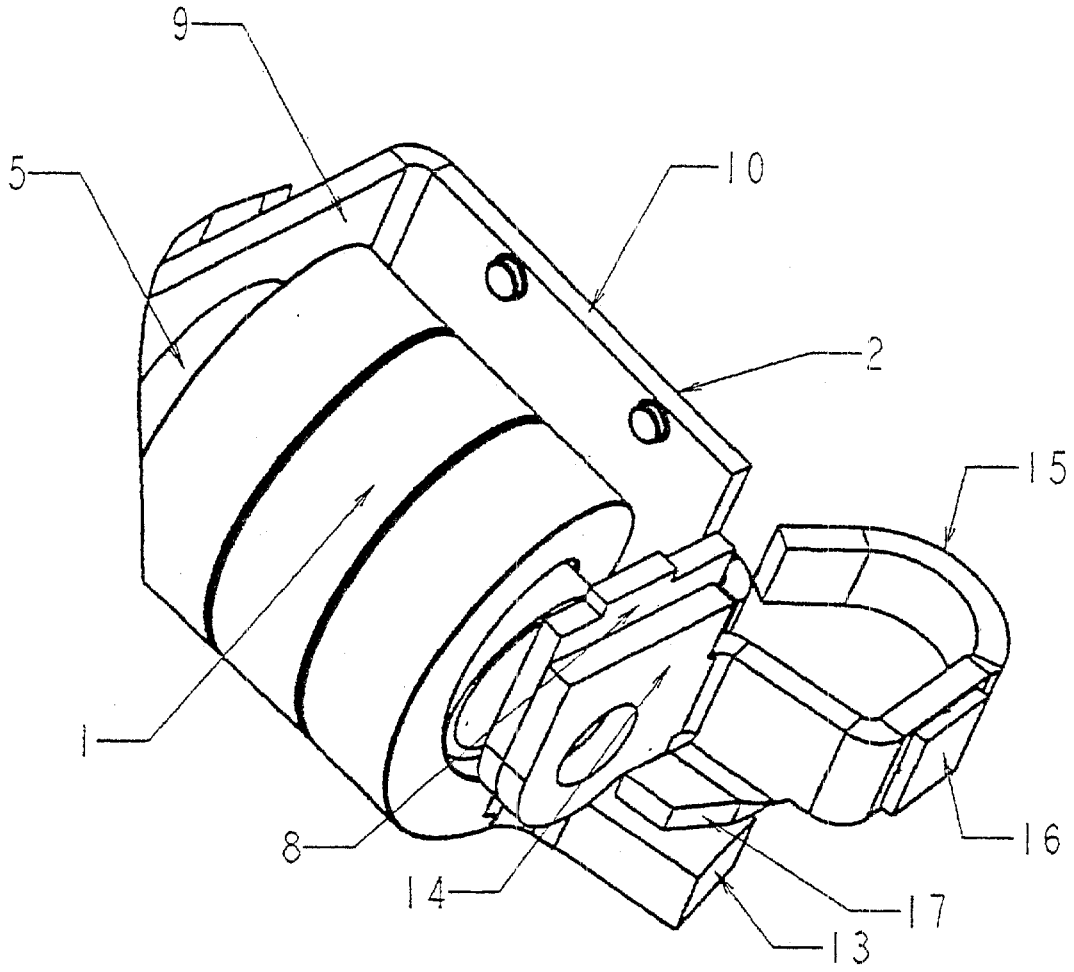
FIG. 5 shows an enlarged detail of the leg enabling the coil to overhang.

The value of FIG. 5 is essentially that of representing the magnetic sub-assembly of the invention when a coil (1) which is too long is inserted there. In this case, only the rounded zones situated in the vicinity of the straight end (13) of the coil (1) should be configured so as not to obstruct the expansion of the coil (1).

The example described in detail in the preceding lines has in no way the effect of limiting the invention and is only illustrative. The invention on the other hand encompasses all variants within reach of a person skilled in the art and contained within the field of protection outlined by the accompanying claims.

What is claimed is:

1. A magnetic sub-assembly for modular electrical equipment of the circuit-breaker type, comprising:

an insulating sheath;

a fixed core, a striker, a return spring and a movable core for driving said striker, wherein said cores, said striker and said spring are positioned in said insulating sheath;

an induction coil wound around said insulating sheath, said coil having first and second sides opposed to each other in an axial direction of said coil, said coil further having a first end at said first side, a second end at said second side, and an inner volume between said first and second ends;

a yoke having a first leg positioned by said second side of said coil and a second leg positioned by said first side of said coil, said first and second legs being parallel to and facing each other to define a second volume therebetween, said fixed core being fixed to said first leg and being a guide for said striker;

a fixed contact to which said second end of said coil is connected at an attachment position, said attachment position being fixed with respect to said yoke; and a terminal for connecting said sub-assembly to the equipment, said second leg of said yoke being attached to said terminal, wherein at least a part of said first leg of said yoke is inside said inner volume of said coil and at least a part of said second end of said coil is axially outside of said second volume, whereby a range of axial dimensions of said coil is allowed within said second volume of said yoke, and wherein said second end of said coil is oriented so that its attachment to said fixed contact does not limit the range of axial dimensions of said coil.

2. The sub-assembly of claim 1, wherein said fixed contact has an extension attached to said first leg of said yoke, said extension including an orifice for housing an end of said fixed core, wherein a periphery of said extension is dimensioned to be partially integrated inside said inner volume of said coil.

3. The sub-assembly of claim 1, wherein said second end of said coil is oriented in a direction substantially parallel to the axial direction of said coil, and wherein said attachment point is a lug having a surface running parallel to said second end.

4. The sub-assembly of claim 1, wherein said coil is made of an electrical wire having a rectangular cross section, said wire having a radial thickness in a radial direction of said coil and an axial width in the axial direction of said coil, said radial thickness being less than said axial width so as to increase said inner volume of said coil and so as to reduce a length of said wire necessary for a fixed length of said coil in the axial direction.

5. The sub-assembly of claim 4, wherein respective diameters of said moving core and said fixed core are sized in correspondence to a size of said inner volume of said coil so as to increase opposing polar areas of said moving core and said fixed core.

6. The sub-assembly of claim 4, wherein said axial width has an increased size corresponding to a decreased thickness of said yoke with an outer volume of said yoke being fixed.

7. The sub-assembly of claim 6, wherein respective diameters of said moving core and said fixed core are sized in correspondence to a size of said inner volume of said coil so as to increase opposing polar areas of said moving core and said fixed core.

8. The sub-assembly of claim 1, wherein said yoke is U-shaped and has an arm connecting said first and second legs, wherein said arm, said fixed contact and said terminal are all positioned on a same longitudinal side of said coil.

9. The sub-assembly of claim 8, wherein said arm includes a lateral notch for accommodating said first end of said coil.

10. The sub-assembly of claim 9, wherein said first end of said coil is oriented in a second direction substantially perpendicular to the axial direction of the coil so as to leave said coil tangentially, wherein said terminal includes a lug having a surface running in the second direction, and wherein said first end is connected to said surface of said lug at said notch.

11. The sub-assembly of claim 9, wherein said yoke surrounds a second volume, wherein said first end of said coil is oriented axially so as to leave said second volume at said notch, and wherein said first end is connected to said terminal outside of said second volume.

12. The sub-assembly of claim 1, wherein said return spring is made of a selected one of copper and steel, said return spring having a lower force when made of copper than when made of steel.

13. The sub-assembly of claim 1, wherein said cores are made of steel.

14. A circuit-breaker, comprising:

modular electrical equipment of the circuit-breaker type; and a magnetic sub-assembly, said sub-assembly comprising: an insulating sheath;

a fixed core, a striker, a return spring and a movable core for driving said striker, wherein said cores, said striker and said spring are positioned in said insulating sheath;

an induction coil wound around said insulating sheath, said coil having first and second sides opposed to each other in an axial direction of said coil, said coil further having a first end at said first side, a second end at said second side, and an inner volume between said first and second ends;

a yoke having a first leg positioned by said second side of said coil and a second leg positioned by said first side of said coil, said first and second legs being parallel to and facing each other to define a second volume therebetween, said fixed core being fixed to said first leg and being a guide for said striker;

a fixed contact to which said second end of said coil is connected at an attachment position, said attachment position being fixed with respect to said yoke; and a terminal for connecting said sub-assembly to said equipment, said second leg of said yoke being attached to said terminal, wherein at least a part of said first leg of said yoke is inside said inner volume of said coil and at least a part of said second end of said coil is axially outside of said second volume, whereby a range of axial dimensions of said coil is allowed within said second volume of said yoke, and wherein said second end of said coil is oriented so that its attachment to said fixed contact does not limit the range of axial dimensions of said coil.

* * * * *